US007217886B2

(12) United States Patent
Mhetar et al.

(10) Patent No.: US 7,217,886 B2
(45) **Date of Patent: *May 15, 2007**

(54) ABRASION RESISTANT ELECTRICAL WIRE

(75) Inventors: Vijay R. Mhetar, Slingerlands, NY (US); Vijay Rajamani, Slingerlands, NY (US); Kristopher Rexius, Waterford, MI (US); Sho Sato, Tochigi-ken (JP); Xiangyang Tai, Tochigi-ken (JP)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/381,607

(22) Filed: May 4, 2006

(65) Prior Publication Data

US 2006/0191706 A1 Aug. 31, 2006

Related U.S. Application Data

(63) Continuation of application No. 11/256,833, filed on Oct. 24, 2005, now Pat. No. 7,084,347.

(60) Provisional application No. 60/637,406, filed on Dec. 17, 2004, provisional application No. 60/637,419, filed on Dec. 17, 2004, provisional application No. 60/637,412, filed on Dec. 17, 2004.

(51) Int. Cl.
*H01B 7/34* (2006.01)

(52) U.S. Cl. ..... 174/110 R; 174/36; 174/120 R

(58) Field of Classification Search ..... 174/36, 174/110 R, 110 SR, 110 N, 110 FC, 110 E, 174/120 R, 120 C, 120 AR, 120 SR, 126.1–126
See application file for complete search history.

(56) References Cited

U.S. PATENT DOCUMENTS

| | | | | |
|---|---|---|---|---|
| 4,166,055 | A | 8/1979 | Lee | 524/141 |
| 4,239,673 | A | 12/1980 | Lee | 524/141 |
| 4,383,082 | A | 5/1983 | Lee | 525/92 D |
| 5,166,264 | A | 11/1992 | Lee et al. | 525/92 D |
| 5,262,480 | A | 11/1993 | Lee | 525/92 D |
| 5,294,655 | A * | 3/1994 | Lee et al. | 524/265 |
| 5,364,898 | A * | 11/1994 | Lee et al. | 524/265 |
| 5,397,822 | A | 3/1995 | Lee | 524/127 |
| 5,455,292 | A | 10/1995 | Kakegawa et al. | 524/141 |
| 6,045,883 | A | 4/2000 | Akiyama et al. | 428/35.7 |
| 6,258,881 | B1 * | 7/2001 | Moritomi | 524/267 |
| 6,322,882 | B1 * | 11/2001 | Moritomi | 428/220 |

(Continued)

FOREIGN PATENT DOCUMENTS

DE 3917342 11/1990

(Continued)

OTHER PUBLICATIONS

ISO 6722 "Road vehicles-60 V and 600 V single-core cables-Dimensions, test methods and requirements" 34 pages.

(Continued)

*Primary Examiner*—William H. Mayo, III
(74) *Attorney, Agent, or Firm*—Cantor Colburn LLP

(57) ABSTRACT

An electrical wire having a conductor and a covering disposed over the conductor wherein the covering has a thermoplastic composition. The thermoplastic composition has a poly(arylene ether); a polyolefin, a block copolymer; and flame retardant.

27 Claims, 1 Drawing Sheet

U.S. PATENT DOCUMENTS

| | | | | |
|---|---|---|---|---|
| 6,495,630 | B2 * | 12/2002 | Adedeji et al. | 525/89 |
| 6,610,422 | B1 | 8/2003 | Ooi et al. | 428/653 |
| 6,627,701 | B2 | 9/2003 | Adedeji et al. | |
| 2001/0053820 | A1 * | 12/2001 | Yeager et al. | 525/186 |
| 2002/0112875 | A1 * | 8/2002 | Hase et al. | 174/120 C |
| 2003/0036602 | A1 * | 2/2003 | Adedeji et al. | 525/88 |
| 2003/0096123 | A1 * | 5/2003 | Yeager | 428/461 |
| 2004/0082719 | A1 | 4/2004 | Adedeji et al. | |
| 2004/0102551 | A1 * | 5/2004 | Sato et al. | 524/115 |
| 2004/0106750 | A1 * | 6/2004 | Yeager et al. | 525/502 |
| 2004/0122153 | A1 * | 6/2004 | Guo et al. | 524/430 |
| 2004/0171733 | A1 * | 9/2004 | Balfour et al. | 524/494 |
| 2004/0177993 | A1 | 9/2004 | Nagai et al. | |
| 2004/0214952 | A1 * | 10/2004 | Kannan et al. | 525/133 |
| 2004/0260036 | A1 * | 12/2004 | Fishburn | 525/474 |

FOREIGN PATENT DOCUMENTS

| | | | |
|---|---|---|---|
| EP | 0362660 | | 4/1990 |
| EP | 0413972 | | 2/1991 |
| EP | 0 413 972 | A2 * | 7/1991 |
| EP | 0467113 | | 1/1992 |
| EP | 0 467 113 | A1 * | 6/1992 |
| EP | 0546841 | | 6/1993 |
| EP | 0 719 833 | A2 * | 12/1995 |
| EP | 0 732 372 | A2 * | 3/1996 |
| EP | 0732372 | A2 | 9/1996 |
| EP | 0639620 | | 4/1999 |
| JP | 11-185532 | | 7/1989 |
| JP | 05-93107 | | 4/1993 |
| JP | 07-224193 | | 8/1995 |
| JP | 11-189690 | | 7/1999 |
| JP | 2003-226792 | | 8/2003 |
| JP | 2003-253066 | | 9/2003 |
| JP | 2004-91692 | | 3/2004 |
| JP | 2004-106513 | | 4/2004 |
| JP | 2004-259683 | | 9/2004 |
| JP | 2004-292660 | | 10/2004 |
| JP | 2004-315645 | | 11/2004 |
| WO | 89/00756 | A1 | 1/1989 |

OTHER PUBLICATIONS

ASTM D638-03 "Standard Test Method for Tensile Properties of Plastic" 15 pages.
ASTM D790-03 "Standard Test Methods for Flexural Properties of Unreinforced and Reinforced Plastics and Electrical Insulating Materials" 11 pages.
ASTM D1238 "Standard Test Method for Melt Flow Rates of Thermoplastics by Extrusion Plastometer" 12 pages.
International Search Report for International Application No. PCT/US2005/043048, mailed Mar. 14, 2006.
Japanese Patent No. JP2003-253066, abstract only.
Japanese Patent No. JP 2004091692, abstract only.
Japanese Patent No. JP 2004106513, abstract only.
Japanese Patent No. JP 2004259683, abstract only.
Japanese Patent No. JP 2004292660, abstract only.
Japanese Patent No. JP 2004315645, abstract only.
Japanese Patent No. JP07-224193, machine translation.
Japanese Patent No. JP11185532, machine translation.
Japanese Patent No. JP 11189690, abstract only.
Japanese Patent No. JP3220231, manual translation.
Japanese Patent No. JP3267146, manual translation.
Japanese Patent No. JP3418209, manual translation.
Japanese Patent No. JP3457042, manual translation.
Japanese Patent No. JP05093107, abstract only.
International Search Report, International Application No. PCT/US2005/042856, 3 pages.

* cited by examiner

ABRASION RESISTANT ELECTRICAL WIRE

CROSS REFERENCE TO RELATED APPLICATIONS

This application is a continuation of U.S. patent application Ser. No. 11/256,833, filed on Oct. 24, 2005, now U.S. Pat. No. 7,084,347, issued on Aug. 1, 2006. which claims priority to U.S. Provisional Application Ser. Nos. 60/637,406, 60/637,419, and 60/637,412 filed on Dec. 17, 2004, which are incorporated in their entirety by reference herein.

BACKGROUND OF INVENTION

Automotive electrical wire located under the hood in the engine compartment has traditionally been insulated with a single layer of high temperature insulation disposed over an uncoated copper conductor. Thermoplastic polyesters, cross linked polyethylene and halogenated resins such as polyvinyl chloride have long filled the need for the high temperature insulation needed in this challenging environment that requires not only heat resistance, chemical resistance, flame retardance, and flexibility.

Thermoplastic polyester insulation layers with outstanding resistance to gas and oil, are mechanically tough and resistant to copper catalyzed degradation but can fail prematurely due to hydrolysis. The insulation layers in thermoplastic polyester insulated electrical wires have also been found to crack when exposed to hot salty water and have failed when subjected to humidity temperature cycling.

There is an increasing desire to reduce or eliminate the use of halogenated resins in coverings due to their negative impact on the environment. In fact, many countries are beginning to mandate a decrease in the use of halogenated materials. However, as much of the wire coating extrusion equipment was created based upon the specifications of halogenated resins such as polyvinyl chloride, any replacement materials must be capable of being handled in a manner similar to polyvinyl chloride.

Cross linked polyethylene has largely been successful in providing high temperature insulation but this success may be difficult to sustain as the requirements for automotive electrical wire evolve. The amount of wiring in automobiles has increased exponentially, as more electronics are being used in modern vehicles. The dramatic increase in wiring has motivated automobile manufacturers to reduce overall wire diameter by specifying reduced insulation layer thicknesses and specifying smaller conductor sizes. For example, ISO 6722 specifies, for a conductor having a cross sectional area of 2.5 square millimeters, that the thin wall insulation thickness be 0.35 millimeters and the ultra thin wall insulation thickness be 0.25 millimeters.

The reductions in insulation wall thickness pose difficulties when using crosslinked polyethylene. For crosslinked polyethylene the thinner insulation layer thickness result in shorter thermal life, when aged at oven temperatures between 150° C. and 180° C. This limits their thermal rating. For example, an electrical wire having a copper conductor with an adjacent crosslinked polyethylene insulation layer having a 0.75 millimeter wall thickness is flexible and the insulation layer does not crack when bent around a mandrel after being exposed to 150° C. for 3,000 hours. But a similar electrical wire having a crosslinked polyethylene insulation layer with a 0.25 millimeter wall thickness the insulation layer becomes brittle after being exposed to 150° C. for 3,000 hours. The deleterious effects created by these extremely thin wall requirements have been attributed to copper catalyzed degradation, which is widely recognized as a problem in the industry.

It is possible to coat the copper core with, e.g., tin, in order to prevent the copper from contacting the crosslinked polyethylene but the additional cost of the coating material and the coating process are expensive. In addition, many automotive specifications require that the copper conductor be uncoated. It is also possible to add stabilizers, also known as metal deactivators, to the insulation material but it is recognized that stabilizers yield only partial protection for electrical wire having thin wall thicknesses.

It has been proposed to employ bilayer or trilayer insulation materials wherein a protective resin based layer is disposed between the crosslinked polyethylene and the copper conductor. However, manufacture of bilayer and trilayer insulation materials is complex, requires increased capital expenditure and the multi layer material presents new issues of inter layer adhesion.

Accordingly, there is an ongoing need for electrical wires having a halogen free covering that are useful in the automotive environment.

BRIEF DESCRIPTION OF THE INVENTION

The above described need is met by a electrical wire comprising:

a conductor; and a covering disposed over the conductor wherein the covering comprises a thermoplastic composition and the thermoplastic composition comprises:

(i) a poly(arylene ether);

(ii) a polyolefin;

(iii) a block copolymer; and (iv) a flame retardant wherein the electrical wire has an abrasion resistance of greater than 100 cycles, as determined by the scrape abrasion specification of ISO 6722 using a 7 Newton load, a needle having a 0.45 millimeter diameters, and an electrical wire having a conductor with a cross sectional area of 0.22 square millimeters and a covering with a thickness of 0.2 millimeters, and wherein the thermoplastic composition has a tensile elongation at break greater than 30% as determined by ASTM D638-03 using a Type I specimen and a speed of 50 millimeters per minute, and a flexural modulus less than 1800 Megapascals (Mpa) as determined by ASTM D790-03 using a speed of 1.27 millimeters per minute.

DETAILED DESCRIPTION

Figure 1:
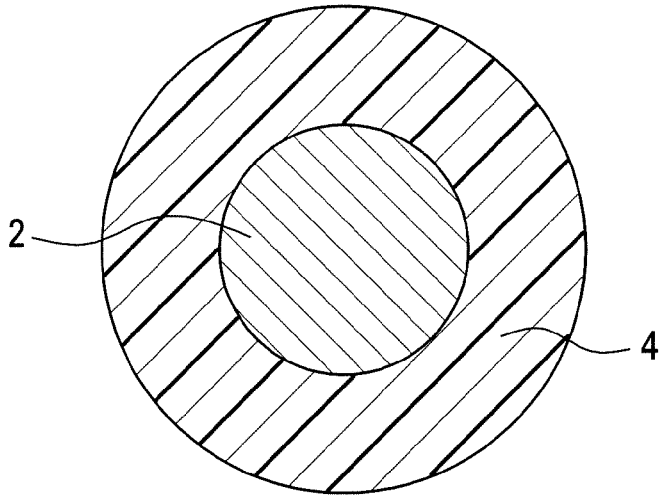
FIG. 1 is a schematic representation of a cross-section of an electrical wire.

In this specification and in the claims, which follow, reference will be made to a number of terms which shall be defined to have the following meanings.

The singular forms "a," "an," and "the" include plural referents unless the context clearly dictates otherwise.

"Optional" or "optionally" means that the subsequently described event or circumstance may or may not occur, and that the description includes instances where the event occurs and instances where it does not.

The endpoints of all ranges reciting the same characteristic are independently combinable and inclusive of the recited endpoint. Values expressed as "greater than about" or "less than about" are inclusive the stated endpoint, for example, "greater than about 3.5" encompasses the value of 3.5.

ISO 6722, when referred to herein, is the Dec. 15, 2002 version of the standard.

As briefly discussed before, electrical wires must meet a wide range of requirements depending upon their application. The requirements for automotive wires are difficult to achieve, particularly in the absence of halogenated materials. In particular, the combination of good abrasion resistance, high tensile elongation and high flexibility is difficult to achieve.

Electrical wires are exposed to significant manipulation during car manufacture as wire harnesses are threaded through a variety of spaces and cavities to achieve the final wiring configuration. This manipulation frequently involves the electrical wires being rubbed along a variety of surfaces. In addition, over the life of the car, many wires are subjected to additional abrasion during normal use. In the past, the thickness of the covering was the primary protection against abrasion and while some material might be worn away, enough remained to provide sufficient electrical insulation. As wiring density increases, the need for electrical wires with thinner coverings increases, making the abrasion resistance of the covering more important.

Abrasion resistance, as described herein, is determined by ISO 6722 on an electrical wire having a conductor with a cross sectional area of 0.22 square millimeters and a covering with a thickness of 0.2 millimeters using a 7 Newton (N) load and a needle with a 0.45 millimeter diameter. Abrasion results are reported in cycles. In various embodiments the abrasion resistance of the electrical wire is greater than 100 cycles, or, more specifically, greater than or equal to 150 cycles, or, even more specifically, greater than or equal to 200 cycles. The maximum number of cycles counted is 1000 and samples having an abrasion resistance greater than 1000 are reported as >1000.

Another important property of the covering is tensile elongation. As the electrical wires are pulled through the various spaces and cavities during automobile manufacture the covering must have sufficient stretch to withstand the manipulation without snapping. In addition, over the life of the car, the tensile elongation remains important for automobile repair and ordinary wear, particularly when attached to movable parts such as seats.

The thermoplastic composition has a tensile elongation at break, as determined by ASTM D638-03 using Type I bars, is greater than or equal to 30%, or, more specifically, greater than or equal to 40%, or, even more specifically, greater than or equal to 50%. The tensile elongation can be less than or equal to 300%. The bars for tensile elongation are molded as described in the Examples.

Another important property of the thermoplastic composition used in the covering is flexibility, as indicated by the flexural modulus. Flexibility is an important property for a covering as the electrical wire must be capable of being bent and manipulated without cracking the covering. A crack in the covering can result in a voltage leak. In addition, several tests included in ISO 6722, the international standard for 60V and 600V single core cables in road vehicles, require that the electrical wire be subjected to a prescribed set of conditions and then wound around a mandrel. After being wound around a mandrel the covering of the electrical wire is examined for cracks and defects. Electrical wires using thermoplastic compositions that are minimally flexible prior to being subjected to conditions such as heat aging or chemical resistance testing frequently have insufficient flexibility, after being subjected to testing conditions, to be wound around a mandrel without cracks developing in the covering.

The thermoplastic composition has a flexural modulus of 800 to less than 1800 Megapascals (MPa). Experience has taught that flexural modulus values of test samples may vary significantly if different molding conditions are used. All flexural modulus values described herein were obtained using samples molded as described in the Examples and tested according to ASTM D790-03. Within this range the flexural modulus may be greater than or equal to 1000 Mpa, or, more specifically, greater than or equal to 1200 Mpa. Also within this range the flexural modulus may be less than or equal to 1700 Mpa, or, more specifically, less than or equal to 1600 Mpa.

While the individual criteria of abrasion resistance, tensile elongation, and flexural modulus may be straightforward to achieve independently, it is surprisingly difficult to achieve adequate performance in all three areas simultaneously.

The thermoplastic composition described herein comprises at least two phases, a polyolefin phase and a poly (arylene ether) phase. The polyolefin phase is a continuous phase. In one embodiment, the poly(arylene ether) phase is dispersed in the polyolefin phase. Good compatibilization between the phases can result in improved physical properties including higher impact strength at low temperatures and room temperature, better heat aging, better flame retardance, as well as greater tensile elongation. It is generally accepted that the morphology of the composition is indicative of the degree or quality of compatibilization. Small, relatively uniformly sized particles of poly(arylene ether) evenly distributed throughout an area of the composition are indicative of good compatibilization.

The thermoplastic compositions described herein are essentially free of an alkenyl aromatic resin such as polystyrene or rubber-modified polystyrene (also known as high impact polystyrene or HIPS). Essentially free is defined as containing less than 10 weight percent (wt %), or, more specifically less than 7 wt %, or, more specifically less than 5 wt %, or, even more specifically less than 3 wt % of an alkenyl aromatic resin, based on the combined weight of poly(arylene ether), polyolefin and block copolymer(s). In one embodiment, the composition is completely free of an alkenyl aromatic resin. Surprisingly the presence of the alkenyl aromatic resin can negatively affect the compatibilization between the poly(arylene ether) phase and the polyolefin phase.

As used herein, a "poly(arylene ether)" comprises a plurality of structural units of the formula (I):

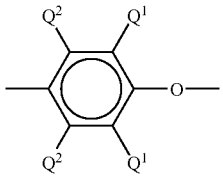

(I)

wherein for each structural unit, each $Q^1$ and $Q^2$ is independently hydrogen, halogen, primary or secondary lower alkyl (e.g., an alkyl containing 1 to 7 carbon atoms), phenyl, haloalkyl, aminoalkyl, alkenylalkyl, alkynylalkyl, hydrocarbonoxy, aryl and halohydrocarbonoxy wherein at least two carbon atoms separate the halogen and oxygen atoms. In some embodiments, each $Q^1$ is independently alkyl or phenyl, for example, $C_{1-4}$ alkyl, and each $Q^2$ is independently hydrogen or methyl. The poly(arylene ether) may comprise molecules having aminoalkyl-containing end group(s), typically located in an ortho position to the hydroxy group. Also frequently present are tetramethyl diphenylquinone (TMDQ) end groups, typically obtained from reaction mixtures in which tetramethyl diphenylquinone by-product is present.

The poly(arylene ether) may be in the form of a homopolymer; a copolymer; a graft copolymer; an ionomer; or a block copolymer; as well as combinations comprising at least one of the foregoing. Poly(arylene ether) includes polyphenylene ether comprising 2,6-dimethyl-1,4-phenylene ether units optionally in combination with 2,3,6-trimethyl-1,4-phenylene ether units.

The poly(arylene ether) may be prepared by the oxidative coupling of monohydroxyaromatic compound(s) such as 2,6-xylenol, 2,3,6-trimethylphenol and combinations of 2,6-xylenol and 2,3,6-trimethylphenol. Catalyst systems are generally employed for such coupling; they can contain heavy metal compound(s) such as a copper, manganese or cobalt compound, usually in combination with various other materials such as a secondary amine, tertiary amine, halide or combination of two or more of the foregoing.

In one embodiment, the poly(arylene ether) comprises a capped poly(arylene ether). The terminal hydroxy groups may be capped with a capping agent via an acylation reaction, for example. The capping agent chosen is preferably one that results in a less reactive poly(arylene ether) thereby reducing or preventing crosslinking of the polymer chains and the formation of gels or black specks during processing at elevated temperatures. Suitable capping agents include, for example, esters of salicylic acid, anthranilic acid, or a substituted derivative thereof, and the like; esters of salicylic acid, and especially salicylic carbonate and linear polysalicylates, are preferred. As used herein, the term "ester of salicylic acid" includes compounds in which the carboxy group, the hydroxy group, or both have been esterified. Suitable salicylates include, for example, aryl salicylates such as phenyl salicylate, acetylsalicylic acid, salicylic carbonate, and polysalicylates, including both linear polysalicylates and cyclic compounds such as disalicylide and trisalicylide. In one embodiment the capping agents are selected from salicylic carbonate and the polysalicylates, especially linear polysalicylates, and combinations comprising one of the foregoing. Exemplary capped poly (arylene ether) and their preparation are described in U.S. Pat. No. 4,760,118 to White et al. and U.S. Pat. No. 6,306,978 to Braat et al.

Capping poly(arylene ether) with polysalicylate is also believed to reduce the amount of aminoalkyl terminated groups present in the poly(arylene ether) chain. The aminoalkyl groups are the result of oxidative coupling reactions that employ amines in the process to produce the poly (arylene ether). The aminoalkyl group, ortho to the terminal hydroxy group of the poly(arylene ether), can be susceptible to decomposition at high temperatures. The decomposition is believed to result in the regeneration of primary or secondary amine and the production of a quinone methide end group, which may in turn generate a 2,6-dialkyl-1-hydroxyphenyl end group. Capping of poly(arylene ether) containing aminoalkyl groups with polysalicylate is believed to remove such amino groups to result in a capped terminal hydroxy group of the polymer chain and the formation of 2-hydroxy-N,N-alkylbenzamine (salicylamide). The removal of the amino group and the capping provides a poly(arylene ether) that is more stable to high temperatures, thereby resulting in fewer degradative products, such as gels, during processing of the poly(arylene ether).

The poly(arylene ether) can have a number average molecular weight of 3,000 to 40,000 grams per mole (g/mol) and a weight average molecular weight of 5,000 to 80,000 g/mol, as determined by gel permeation chromatography using monodisperse polystyrene standards, a styrene divinyl benzene gel at 40° C. and samples having a concentration of 1 milligram per milliliter of chloroform. The poly(arylene ether) or combination of poly(arylene ether)s has an initial intrinsic viscosity greater than 0.3 deciliters per gram (dl/g), as measured in chloroform at 25° C. Initial intrinsic viscosity is defined as the intrinsic viscosity of the poly(arylene ether) prior to melt mixing with other components of the composition. As understood by one of ordinary skill in the art the viscosity of the poly(arylene ether) may be up to 30% higher after melt mixing. The percentage of increase can be calculated by (final intrinsic viscosity after melt mixing−initial intrinsic viscosity before melt mixing)/initial intrinsic viscosity before melt mixing. Determining an exact ratio, when two initial intrinsic viscosities are used, will depend somewhat on the exact intrinsic viscosities of the poly(arylene ether) used and the ultimate physical properties that are desired.

The poly(arylene ether) used to make the thermoplastic composition can be substantially free of visible particulate impurities. In one embodiment, the poly(arylene ether) is substantially free of particulate impurities greater than 15 micrometers in diameter. As used herein, the term "substantially free of visible particulate impurities" when applied to poly(arylene ether) means that a ten gram sample of a poly(arylene ether) dissolved in fifty milliliters of chloroform ($CHCl_3$) exhibits fewer than 5 visible specks when viewed in a light box with the naked eye. Particles visible to the naked eye are typically those greater than 40 micrometers in diameter. As used herein, the term "substantially free of particulate impurities greater than 15 micrometers" means that of a forty gram sample of poly(arylene ether) dissolved in 400 milliliters of $CHCl_3$, the number of particulates per gram having a size of 15 micrometers is less than 50, as measured by a Pacific Instruments ABS2 analyzer based on the average of five samples of twenty milliliter quantities of the dissolved polymeric material that is allowed to flow through the analyzer at a flow rate of one milliliter per minute (plus or minus five percent).

The composition may comprise the poly(arylene ether) in an amount of 35 to 65 weight percent (wt %), based on the combined weight of the poly(arylene ether), polyolefin, flame retardant and block copolymer. Within this range the amount of poly(arylene ether) may be greater than or equal to 37 wt %, or, more specifically, greater than or equal to 40 wt %. Also within this range the amount of poly(arylene ether) may be less than or equal to 60 wt %, or, more specifically, less than or equal to 55 wt %.

The polyolefin may comprise polypropylene, high density polyethylene, or a combination of polypropylene and high density polyethylene.

The polypropylene can be homopolypropylene or a polypropylene copolymer. Copolymers of polypropylene and rubber or block copolymers are sometimes referred to as impact modified polypropylene. Such copolymers are typically heterophasic and have sufficiently long sections of each component to have both amorphous and crystalline phases. Additionally the polypropylene may comprise a combination of homopolymer and copolymer, a combination of homopolymers having different melting temperatures, and/or a combination of homopolymers having a different melt flow rate.

In one embodiment the polypropylene comprises a crystalline polypropylene such as isotactic polypropylene. Crystalline polypropylenes are defined as polypropylenes having a crystallinity content greater than or equal to 20%, or, more specifically, greater than or equal to 25%, or, even more specifically, greater than or equal to 30%. Crystallinity may be determined by differential scanning calorimetry (DSC).

In some embodiments the polypropylene has a melting temperature greater than or equal to 134° C., or, more specifically, greater than or equal to 140° C., or, even more specifically, greater than or equal to 145° C. In one embodiment, the polypropylene has a melt temperature less than or equal to 175° C.

The polypropylene has a melt flow rate (MFR) greater than 0.4 grams per 10 minutes and less than or equal to 15 grams per ten minutes (g/10 min.). Within this range the melt flow rate may be greater than or equal to 0.6 g/10 min. Also within this range the melt flow rate may be less than or equal to 10, or, more specifically, less than or equal to 6, or, more specifically, less than or equal to 5 g/10 min. Melt flow rate can be determined according to ASTM D1238 using either powdered or pelletized polypropylene, a load of 2.16 kilograms and a temperature as 230.

The high density polyethylene can be homo polyethylene or a polyethylene copolymer. Additionally the high density polyethylene may comprise a combination of homopolymer and copolymer, a combination of homopolymers having different melting temperatures, and/or a combination of homopolymers having a different melt flow rate. The high density polyethylene can have a density of 0.941 grams per cubic centimeter to 0.965 grams per centimeter.

In some embodiments the high density polyethylene has a melting temperature greater than or equal to 124° C., or, more specifically, greater than or equal to 126° C., or, even more specifically, greater than or equal to 128° C. In one embodiment, the melting temperature of the high density polyethylene is less than or equal to 140° C.

The high density polyethylene has a melt flow rate (MFR) greater than or equal to 0.29 grams per 10 minutes and less than or equal to 15 grams per ten minutes (g/10 min). Within this range the melt flow rate may be greater than or equal to 1.0 g/10 min. Also within this range the melt flow rate may be less than or equal to 10, or, more specifically, less than or equal to 6, or, more specifically, less than or equal to 5 g/10 min. Melt flow rate can be determined according to ASTM D1238 using either powdered or pelletized polyethylene, a load of 2.16 kilograms and a temperature as 190.

The composition may comprise the polyolefin in an amount of 25 to 40 weight percent (wt %), based on the combined weight of the poly(arylene ether), polyolefin, flame retardant and block copolymer. Within this range the amount of polyolefin may be greater than or equal to 27 wt %, or, more specifically, greater than or equal to 30 wt %. Also within this range the amount of polyolefin may be less than or equal to 37 wt %, or, more specifically, less than or equal to 35 wt %.

In some embodiments the weight ratio of the poly(arylene ether) to the polyolefin is 1.0 to 1.6.

As used herein and throughout the specification "block copolymer" refers to a single block copolymer or a combination of block copolymers. The block copolymer comprises at least one block (A) comprising repeating aryl alkylene units and at least one block (B) comprising repeating alkylene units. The arrangement of blocks (A) and (B) may be a linear structure or a so-called radial teleblock structure having branched chains. A-B-A triblock copolymers have two blocks A comprising repeating aryl alkylene units. A-B diblock copolymers have one block A comprising repeating aryl alkylene units. The pendant aryl moiety of the aryl alkylene units may be monocyclic or polycyclic and may have a substituent at any available position on the cyclic portion. Suitable substituents include alkyl groups having 1 to 4 carbons. An exemplary aryl alkylene unit is phenylethylene, which is shown in Formula II:

(II)

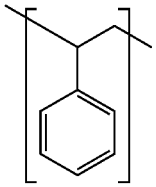

Block A may further comprise alkylene units having 2 to 15 carbons as long as the quantity of aryl alkylene units exceeds the quantity of alkylene units. Block B comprises repeating alkylene units having 2 to 15 carbons such as ethylene, propylene, butylene or combinations of two or more of the foregoing. Block B may further comprise aryl alkylene units as long as the quantity of alkylene units exceeds the quantity of aryl alkylene units. Each occurrence of block A may have a molecular weight which is the same or different than other occurrences of block A. Similarly each occurrence of block B may have a molecular weight which is the same or different than other occurrences of block B. The block copolymer may be functionalized by reaction with an alpha-beta unsaturated carboxylic acid.

In one embodiment, the B block comprises a copolymer of aryl alkylene units and alkylene units having 2 to 15 carbons such as ethylene, propylene, butylene or combinations of two or more of the foregoing. The B block may further comprise some unsaturated carbon-carbon bonds. The B block may be a controlled distribution copolymer. As used herein "controlled distribution" is defined as referring to a molecular structure lacking well-defined blocks of either monomer, with "runs" of any given single monomer attaining a maximum number average of 20 units as shown by either the presence of only a single glass transition temperature (Tg), intermediate between the Tg of either homopolymer, or as shown via proton nuclear magnetic resonance methods. Each A block may have an average molecular weight of 3,000 to 60,000 g/mol and each B block may have an average molecular weight of 30,000 to 300,000 g/mol. Each B block comprises at least one terminal region adjacent to an A block that is rich in alkylene units and a region not adjacent to the A block that is rich in aryl alkylene units. The total amount of aryl alkylene units is 15 to 75 weight percent, based on the total weight of the block copolymer. The weight ratio of alkylene units to aryl alkylene units in the B block may be 5:1 to 1:2. Exemplary block copolymers are further disclosed in U.S. patent application No. 2003/181584 and are commercially available from Kraton Polymers under the trademark KRATON. Exemplary grades are A-RP6936 and A-RP6935.

The repeating aryl alkylene units result from the polymerization of aryl alkylene monomers such as styrene. The repeating alkylene units result from the hydrogenation of repeating unsaturated units derived from a diene such as butadiene. The butadiene may comprise 1,4-butadiene and/or 1,2-butadiene. The B block may further comprise some unsaturated non-aromatic carbon-carbon bonds.

Exemplary block copolymers include polyphenylethylene-poly(ethylene/propylene) which is sometimes referred to as polystyrene-poly(ethylene/propylene), polyphenylethylene-poly(ethylene/propylene)-polyphenylethylene (sometimes referred to as polystyrene-poly(ethylene/propylene)-polystyrene) and polyphenylethylene-poly(ethylene/butylene)-polyphenylethylene (sometimes referred to as polystyrene-poly(ethylene/butylene)-polystyrene).

In one embodiment, the thermoplastic composition comprises two block copolymers. The first block copolymer has an aryl alkylene content greater than to equal to 50 weight percent based on the total weight of the first block copolymer. The second block copolymer has an aryl alkylene content less than 50 weight percent based on the total weight of the second block copolymer. An exemplary combination of block copolymers is a first polyphenylethylene-poly(ethylene/butylene)-polyphenylethylene having a phenylethylene content of 15 weight percent to 40 weight percent, based on the total weight of the block copolymer and a second polyphenylethylene-poly(ethylene/butylene)-polyphenylethylene having a phenylethylene content of 55 weight percent to 70 weight percent, based on the total weight of the block copolymer may be used. Exemplary block copolymers having an aryl alkylene content greater than 50 weight percent are commercially available from Asahi under the trademark TUFTEC and have grade names such as H1043, as well as some grades available under the tradename SEPTON from Kuraray. Exemplary block copolymers having an aryl alkylene content less than 50 weight percent are commercially available from Kraton Polymers under the trademark KRATON and have grade names such as G-1701, G-1702, G-1730, G-1641, G-1650, G-1651, G-1652, G-1657, A-RP6936 and A-RP6935.

In one embodiment, the thermoplastic composition comprises a diblock copolymer and a triblock copolymer. The weight ratio of the triblock copolymer to the diblock copolymer may be 1:3 to 3:1.

In some embodiments the block copolymer has a number average molecular weight of 5,000 to 1,000,000 grams per mole (g/mol). Within this range, the number average molecular weight may be at least 10,000 g/mol, or, more specifically, at least 30,000 g/mol, or, even more specifically, at least 45,000 g/mol. Also within this range, the number average molecular weight may preferably be up to 800,000 g/mol, or, more specifically, up to 700,000 g/mol, or, even more specifically, up to 650,000 g/mol.

The block copolymer is present in an amount of 7 to 20 weight percent, based on the combined weight of the poly(arylene ether), polyolefin, flame retardant and block copolymer. Within this range the block copolymer may be present in an amount greater than or equal to 8, or, more specifically, greater than or equal to 9 weight percent based on the combined weight of the poly(arylene ether), polyolefin, flame retardant and block copolymer. Also within this range the block copolymer may be present in an amount less than or equal to 14, or, more specifically, less than or equal to 13, or, even more specifically, less than or equal to 12 weight percent based on the combined weight of the poly(arylene ether), polyolefin, flame retardant and block copolymer.

Exemplary flame retardants include organic phosphate ester flame retardants such as phosphate esters comprising phenyl groups, substituted phenyl groups, or a combination of phenyl groups and substituted phenyl groups, bis-aryl phosphate esters based upon resorcinol such as, for example, resorcinol bis-diphenylphosphate, as well as those based upon bis-phenols such as, for example, bis-phenol A bis-diphenylphosphate. In one embodiment, the organic phosphate ester is selected from tris(alkylphenyl) phosphate (for example, CAS No. 89492-23-9 and/or 78-33-1), resorcinol bis-diphenylphosphate (for example, CAS No. 57583-54-7), bis-phenol A bis-diphenylphosphate (for example, CAS No. 181028-79-5), triphenyl phosphate (for example, CAS No. 115-86-6), tris(isopropylphenyl) phosphate (for example, CAS No. 68937-41-7) and mixtures of two or more of the foregoing.

In one embodiment the organic phosphate ester comprises a bis-aryl phosphate having the Formula III:

(III)

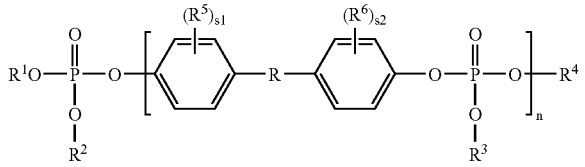

wherein R, $R^5$ and $R^6$ are independently an alkyl group having 1 to 5 carbons and $R^1$–$R^4$ are independently an alkyl, aryl, arylalkyl or alkylaryl group having 1 to 10 carbons; n is an integer equal to 1 to 25; and s1 and s2 are independently an integer equal to 0 to 2. In some embodiments $OR^1$, $OR^2$, $OR^3$ and $OR^4$ are independently derived from phenol, a monoalkylphenol, a dialkylphenol or a trialkylphenol.

As readily appreciated by one of ordinary skill in the art, the bis-aryl phosphate is derived from a bisphenol. Exemplary bisphenols include 2,2-bis(4-hydroxyphenyl)propane (so-called bisphenol A), 2,2-bis(4-hydroxy-3-methylphenyl)propane, bis(4-hydroxyphenyl)methane, bis(4-hydroxy-3,5-dimethylphenyl)methane and 1,1-bis(4-hydroxyphenyl)ethane. In one embodiment, the bisphenol comprises bisphenol A.

Organophosphate esters can have differing molecular weights making the determination of the amount of different organic phosphate esters difficult. In one embodiment the amount of phosphorus, as the result of the organophosphate ester, is 0.8 weight percent to 1.2 weight percent based on the combined weight of poly(arylene ether), polyolefin, block copolymer and flame retardant.

In one embodiment, the amount of the flame retardant is sufficient for the electrical wire to have an average flame out time less than or equal to 10 seconds wherein the average flame out time is based on 10 samples. Flame out time is determined by the flame propagation procedure contained in ISO 6722 for cables with a cross sectional area less than or equal to 2.5 square millimeters using a electrical wire having a conductor with a cross sectional area of 0.2 square millimeters and an covering thickness of 0.2 millimeters.

In one embodiment, the flame retardant is present in an amount of 5 to 18 weight percent, based on the combined weight of poly(arylene ether), polyolefin, block copolymer and flame retardant. Within this range the amount of flame retardant can be greater than or equal to 7, or more specifically, greater than or equal to 9 weight percent. Also within this range the amount of flame retardant can be less than or equal to 16, or, more specifically, less than or equal to 14 weight percent.

Additionally, the thermoplastic composition may optionally also contain various additives, such as antioxidants; fillers and reinforcing agents having an average particle size less than or equal to 10 micrometers, such as, for example, silicates, $TiO_2$, fibers, glass fibers, glass spheres, calcium carbonate, talc, and mica; mold release agents; UV absorbers; stabilizers such as light stabilizers and others; lubricants; plasticizers; pigments; dyes; colorants; anti-static agents; blowing agents, foaming agents, metal deactivators, and combinations comprising one or more of the foregoing additives.

In one embodiment the electrical wire comprises an conductor and a covering disposed over the conductor. The covering comprises a thermoplastic composition consisting essentially of poly(arylene ether) having an initial intrinsic viscosity greater than 0.35 dl/g, as measured in chloroform at 25° C.; a polypropylene having a melting temperature greater than or equal to 145° C. and a melt flow rate of 0.4 g/10 min to 15 g/10 min; a bis-aryl phosphate and a combination of two block copolymers having different aryl alkylene contents wherein a first block copolymer has an aryl alkylene content greater than or equal to 50 weight percent based on the total weight of the first block copolymer and a second block copolymer has an aryl alkylene content less than 50 weight percent based on the total weight of the second block copolymer. The poly(arylene ether) is present in an amount by weight greater than the amount by weight of polyolefin. The electrical wire has an abrasion resistance of greater than 100 cycles, as determined by the scrape abrasion specification of ISO 6722 using a 7 Newton load, a needle having a diameter of 0.45 millimeter and a electrical wire having a conductor with a cross sectional area of 0.22 square millimeters and a covering with a thickness of 0.2 millimeters. The thermoplastic composition has a tensile elongation at break greater than 30%, as determined by ASTM D638-03 using a Type I bar and a speed of 50 millimeters per minute, and a flexural modulus less than 1800 Megapascals (Mpa) as determined by ASTM D790-03 using a speed of 1.27 millimeters per minute.

In one embodiment an electrical wire comprises a conductor and a covering disposed over the conductor. The covering comprises a thermoplastic composition consisting essentially of:

40 to 55 weight percent of a poly(arylene ether);

25 to 35 weight percent of a polyolefin;

7 to 12 weight percent of a block copolymer; and 8 to 12 weight percent of a flame retardant wherein the weight percents are based on the combined weight of the poly(arylene ether), the polyolefin, the block copolymer, and the flame retardant. The electrical wire has an abrasion resistance of greater than 100 cycles, as determined by the scrape abrasion specification of ISO 6722 using a 7 Newton load, a needle having a diameter of 0.45 millimeter and a electrical wire having a conductor with a cross sectional area of 0.22 square millimeters and a covering with a thickness of 0.2 millimeters. The thermoplastic composition has a tensile elongation at break greater than 30%, as determined by ASTM D638-03 using a Type I bar and a speed of 50 millimeters per minute, and a flexural modulus less than 1800 Megapascals (Mpa) as determined by ASTM D790-03 using a speed of 1.27 millimeters per minute.

The components of the thermoplastic composition are melt mixed, typically in a melt mixing device such as an compounding extruder or Banbury mixer. In one embodiment, the poly(arylene ether), polymeric compatibilizer, and polyolefin are simultaneously melt mixed. In another embodiment, the poly(arylene ether), polymeric compatibilizer, and optionally a portion of the polyolefin are melt mixed to form a first melt mixture. Subsequently, the polyolefin or remainder of the polyolefin is further melt mixed with the first melt mixture to form a second melt mixture. Alternatively, the poly(arylene ether) and a portion of the polymeric compatibilizer may be melt mixed to form a first melt mixture and then the polyolefin and the remainder of the polymeric compatibilizer are further melt mixed with the first melt mixture to form a second melt mixture.

The aforementioned melt mixing processes can be achieved without isolating the first melt mixture or can be achieved by isolating the first melt mixture. One or more melt mixing devices including one or more types of melt mixing devices can be used in these processes. In one embodiment, some components of the thermoplastic composition that forms the covering may be introduced and melt mixed in an extruder used to coat the conductor.

When the block copolymer comprises two block copolymers, one having an aryl alkylene content greater than or equal to 50 weight percent and a second one having an aryl alkylene content less than 50 weight percent, the poly (arylene ether) and the block copolymer having an aryl alkylene content greater than or equal to 50 weight percent can be melt mixed to form a first melt mixture and the polyolefin and a block copolymer having an aryl alkylene content less than 50 weight percent can be melt mixed with the first melt mixture to form a second melt mixture.

The method and location of the addition of the optional flame retardant is typically dictated by the identity and physical properties, e.g., solid or liquid, of the flame retardant as well understood in the general art of polymer alloys and their manufacture. In one embodiment, the flame retardant is combined with one of the components of the thermoplastic composition, e.g., a portion of the polyolefin, to form a concentrate that is subsequently melt mixed with the remaining components.

The poly(arylene ether), block copolymer, polyolefin and optional flame retardant are melt mixed at a temperature greater than or equal to the glass transition temperature of the poly(arylene ether) but less than the degradation temperature of the polyolefin. For example, the poly(arylene ether), polymeric compatibilizer, polyolefin and optional flame retardant may be melt mixed at an extruder temperature of 240° C. to 320° C., although brief periods in excess of this range may occur during melt mixing. Within this range, the temperature may be greater than or equal to 250° C., or, more specifically, greater than or equal to 260° C. Also within this range the temperature may be less than or equal to 310° C., or, more specifically, less than or equal to 300° C.

After some or all the components are melt mixed, the molten mixture can be melt filtered through one of more filters having openings with diameters of 20 micrometers to 150 micrometers. Within this range, the openings may have diameters less than or equal to 130 micrometers, or, more specifically, less than or equal to 110 micrometers. Also within this range the openings can have diameters greater than or equal to 30 micrometers, or, more specifically, greater than or equal to 40 micrometers. In one embodiment the molten mixture is melt filtered through one or more filters having openings with a maximum diameter that is less than or equal to half of the thickness of the covering on the conductor.

The thermoplastic composition can be formed into pellets, either by strand pelletization or underwater pelletization, cooled, and packaged. In one embodiment the pellets are packaged into metal foil lined plastic, e.g., polypropylene, bags or metal foil lined paper bags. Substantially all of the air can be evacuated from the pellet filled bags.

In one embodiment, the thermoplastic composition is substantially free of visible particulate impurities. As used herein, the term "substantially free of visible particulate impurities" when applied to the thermoplastic composition means that when the composition is injection molded to form 5 plaques having dimensions of 75 mm×50 mm and having a thickness of 3 mm and the plaques are visually inspected for black specks with the naked eye the total number of black specks for all five plaques is less than or equal to 100, or, more specifically, less than or equal to 70, or, even more specifically, less than or equal to 50.

In one embodiment the pellets are melted and the composition applied to the conductor by a suitable method such as extrusion coating to form an electrical wire. For example, a coating extruder equipped with a screw, crosshead, breaker plate, distributor, nipple, and die can be used. The melted thermoplastic composition forms a covering disposed over a circumference of the conductor. Extrusion coating may employ a single taper die, a double taper die, other appropriate die or combination of dies to position the conductor centrally and avoid die lip build up.

In some embodiments it may be useful to dry the thermoplastic composition before extrusion coating. Exemplary drying conditions are 60–90° C. for 2–20 hours. Additionally, in one embodiment, during extrusion coating, the thermoplastic composition is melt filtered, prior to formation of the covering, through one or more filters having opening diameters of 20 micrometers to 150 micrometers. Within this range, the openings diameters may be greater than or equal to 30 micrometers, or more specifically greater than or equal to 40 micrometers. Also within this range the openings diameters may be less than or equal to 130 micrometers, or, more specifically, less than or equal to 110 micrometers. Alternatively, the one or more filters have openings with a maximum diameter that is less than or equal to half the thickness of the covering on the conductor.

The extruder temperature during extrusion coating is generally less than or equal to 320° C., or, more specifically, less than or equal to 310° C., or, more specifically, less than or equal to 290° C. Additionally the processing temperature is adjusted to provide a sufficiently fluid molten composition to afford a covering for the conductor, for example, higher than the melting point of the thermoplastic composition, or more specifically at least 10° C. higher than the melting point of the thermoplastic composition.

After extrusion coating the electrical wire is usually cooled using a water bath, water spray, air jets or a combination comprising one or more of the foregoing cooling methods. Exemplary water bath temperatures are 20 to 85° C. After cooling the electrical wire is wound onto a spool or like device, typically at a speed of 50 meters per minute (m/min) to 1500 m/min.

In one embodiment, the composition is applied to the conductor to form a covering disposed over the conductor. Additional layers may be applied to the covering.

In one embodiment the composition is applied to a conductor having one or more intervening layers between the conductor and the covering to form a covering disposed over the conductor. For instance, an optional adhesion promoting layer may be disposed between the conductor and covering. In another example the conductor may be coated with a metal deactivator prior to applying the covering. In another example the intervening layer comprises a thermoplastic or thermoset composition that, in some cases, is foamed.

The conductor may comprise a single strand or a plurality of strands. In some cases, a plurality of strands may be bundled, twisted, or braided to form a conductor. Additionally, the conductor may have various shapes such as round or oblong. Suitable conductors include, but are not limited to, copper wire, aluminum wire, lead wire, and wires of alloys comprising one or more of the foregoing metals. The conductor may also be coated with, e.g., tin or silver.

The cross-sectional area of the conductor and thickness of the covering may vary and is typically determined by the end use of the electrical wire. The electrical wire can be used as electric wire without limitation, including, for example, for harness wire for automobiles, wire for household electrical appliances, wire for electric power, wire for instruments, wire for information communication, wire for electric cars, as well as ships, airplanes, and the like.

Figure 2:
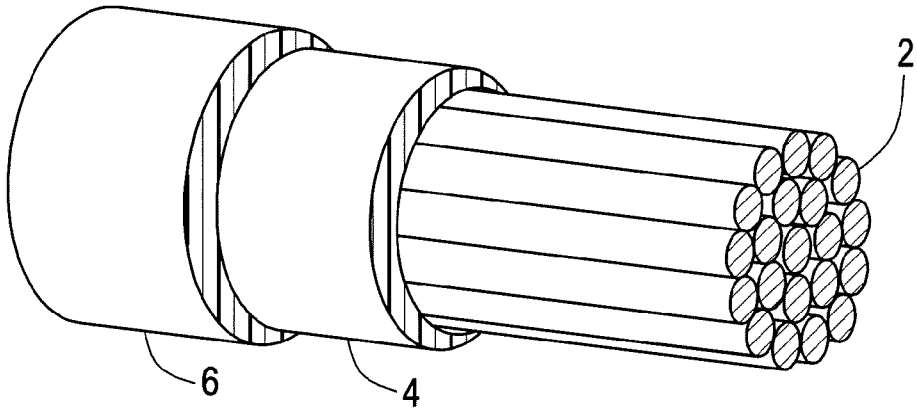
FIGS. 2 and 3 are perspective views of an electrical wire having multiple layers.
Figure 3:
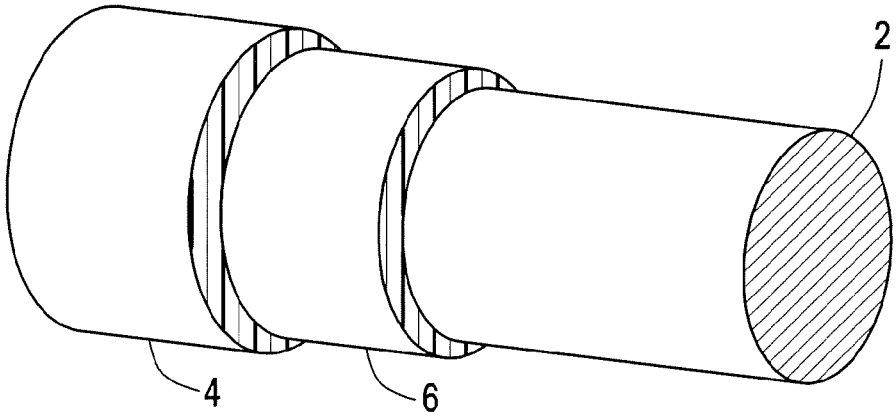

A cross-section of an exemplary electrical wire is seen in FIG. 1. FIG. 1 shows a covering, 4, disposed over a conductor, 2. In one embodiment, the covering, 4, comprises a foamed thermoplastic composition. Perspective views of exemplary electrical wires are shown in FIGS. 2 and 3. FIG. 2 shows a covering, 4, disposed over a conductor, 2, comprising a plurality of strands and an optional additional layer, 6, disposed over the covering, 4, and the conductor, 2. In one embodiment, the covering, 4, comprises a foamed thermoplastic composition. Conductor, 2, can also comprise a unitary conductor. FIG. 3 shows a covering, 4, disposed over a unitary conductor, 2, and an intervening layer, 6. In one embodiment, the intervening layer, 6, comprises a foamed composition. Conductor, 2, can also comprise a plurality of strands.

A color concentrate or masterbatch may be added to the composition prior to or during the extrusion coating process. When a color concentrate is used it is typically present in an amount less than or equal to 3 weight percent, based on the total weight of the composition. In one embodiment dye and/or pigment employed in the color concentrate is free of chlorine, bromine and fluorine. As appreciated by one of skill in the art, the color of the composition prior to the addition of color concentrate may impact the final color achieved and in some cases it may be advantageous to employ a bleaching agent and/or color stabilization agents. Bleaching agents and color stabilization agents are known in the art and are commercially available.

The composition and electrical wire are further illustrated by the following non-limiting examples.

EXAMPLES

The following examples were prepared using the materials listed in Table 1.

TABLE 1

| Component | Description |
|---|---|
| PPE | A poly(2,6-dimethylphenylene ether) with an intrinsic viscosity of 0.46 dl/g as measured in chloroform at 25° C. commercially available from General Electric under the grade name PPO646. |

TABLE 1-continued

| Component | Description |
|---|---|
| KG1650 | A polyphenylethylene-poly(ethylene/butylene)-polyphenylethylene block copolymer having a phenylethylene content of 30 weight percent, based on the total weight of the block copolymer and commercially available from KRATON Polymers under the grade name G 1650. |
| PP | A polypropylene having a melt flow rate of 1.5 g/10 min determined according to ASTM D1238 as described above and commercially under the tradename D-015-C from Sunoco Chemicals. |
| Tuftec H1043 | A polyphenylethylene-poly(ethylene/butylene)-polyphenylethylene block copolymer having a phenylethylene content of 67 weight percent, based on the total weight of the block copolymer and commercially available from Asahi Chemical. |
| KG1657 | A mixture of polyphenylethylene-poly(ethylene/propylene) and polyphenylethylene-poly(ethylene/butylene)-polyphenylethylene block copolymers having a phenylethylene content of 13 weight percent, based on the total weight of the block copolymers and commercially available from KRATON Polymers under the grade name G 1657. |
| HDPE | A high density polyethylene having a melt flow rate of 0.8 g/10 min determined according to ASTM D1238 as described above and commercially available from Mitsui Chemicals under the tradename HI-ZEX 5305E. |
| BPADP | Bis-phenol A bis-diphenylphosphate (CAS 181028-79-5) |

Examples 1–12

Examples 1–12 were made by combining the components in a twin screw extruder. The PPE and block copolymers were added at the feedthroat and the PP was added downstream. The organophosphate ester was added by a liquid injector in the second (downstream) half of the extruder. The material was pelletized at the end of the extruder and the pelletized material was injected molded into test specimens for flexural modulus and tensile elongation testing.

Flexural modulus (FM) was determined using ASTM D790-03 at a speed of 1.27 millimeters per minute and is expressed in Megapascals (MPa). The values given are the average of three samples. Tensile elongation was determined at break using ASTM D638-03 at a speed of 50 millimeters per minute and Type I bars. The values are expressed in percentage (%). The values given are the average of 3 samples. The samples for flexural modulus and tensile elongation were injection molded using an injection pressure of 600–700 kilograms-force per square centimeter and a hold time of 15 to 20 seconds on a Plastar Ti-80$G_2$ from Toyo Machinery & Metal Co. LTD. The remaining molding conditions are shown in Table 2.

Abrasion resistance was determined on an electrical wire having a conductor with a 0.22 square millimeter cross sectional area and a covering with a 0.2 millimeter insulation thickness. Abrasion resistance was tested according to ISO 6722 using a 7 Newton (N) load and a needle with a 0.45 millimeter diameter. The results are expressed in cycles.

The compositions of the Examples and data are listed in Table 3.

Electrical wires, as described with regard to abrasion resistance, were produced using the composition of Examples 1–12. The thermoplastic composition was dried at 80° C. for 3–4 hours prior to extrusion with the conductor to form the electrical wire.

TABLE 2

| | |
|---|---|
| Drying temperature (° C.) | 80 |
| Dry time in hours | 4 |
| Cylinder temperature | |
| 1 | 240 |
| 2 | 250 |
| 3 | 260 |
| 4 | 260 |
| DH | 260 |
| Mold temperature | 80 |

TABLE 3

| | 1 | 2* | 3 | 4 | 5* | 6* | 7* | 8* | 9* | 10* | 11* | 12* | 13 |
|---|---|---|---|---|---|---|---|---|---|---|---|---|---|
| PPE | 50 | 40 | 50 | 40 | 50 | 50 | 55 | 55 | 55 | 45 | 45 | 55 | 52 |
| KG 1650 | 10 | 10 | 5 | 5 | — | — | 5 | — | — | 15 | — | — | 5 |
| Tuftec H1043 | — | — | 5 | 5 | 10 | — | — | 5 | — | — | 15 | 15 | 5 |
| KG1657 | — | — | — | — | — | 10 | — | — | 5 | — | — | — | — |
| PP | 30 | 40 | 30 | 40 | 30 | 30 | 30 | 30 | 30 | 30 | 30 | 20 | 29 |
| BPADP | 10 | 10 | 10 | 10 | 10 | 10 | 10 | 10 | 10 | 10 | 10 | 10 | 9 |
| Tensile Elongation | 64 | 93 | 130 | 181 | 129 | 30 | 16 | 21 | 13 | 108 | 145 | 63 | 85 |
| FM | 1512 | 1402 | 1589 | 1456 | 1988 | 1096 | 1788 | 2091 | 1489 | 1269 | 1933 | 2103 | 1555 |
| Abrasion resistance | 255 | 91 | 359 | 190 | 448 | 59 | 231 | 338 | 167 | 65 | 367 | 732 | 450 |

*Comparative Example

Examples 1–13 show that achieving the desired tensile elongation, flexural modulus and abrasion resistance in a single composition is surprisingly difficult. Example 1 exhibits all three desirable properties—an abrasion resistance greater than 100 cycles, a flexural modulus less than 1800 Mpa, and a tensile elongation at break greater than 30%, yet Example 2, which has an increase of 10 weight percent in polypropylene and a decrease of 10 weight percent poly(arylene ether) fails to have adequate abrasion resistance. Examples 3 and 4, which show the same trend in poly(arylene ether) and polypropylene amounts as Examples 1 and 2, both have sufficient tensile elongation, flexural modulus, and abrasion resistance. The difference between Examples 1 and 2 versus 3 and 4 being the composition of the block copolymer. Example 5, which employs a block copolymer having a higher phenylethylene content than the block copolymer used in Example 1, demonstrates excellent abrasion resistance but has a flexural modulus that is too high. Example 6, which employs a block copolymer having a lower phenylethylene content than the block copolymer used in Example 1 has a low flexural modulus but demonstrates poor abrasion resistance.

Examples 14–24

Examples 14–24 were made as described above with regard to Examples 1–13. Compositions and results are shown in Table 4.

TABLE 4

| | 14 | 15 | 16 | 17 | 18* | 19 | 20* | 21* | 22* | 23 | 24* | 25* |
|---|---|---|---|---|---|---|---|---|---|---|---|---|
| PPE | 50 | 40 | 50 | 40 | 50 | 50 | 55 | 55 | 55 | 45 | 45 | 55 |
| KG 1650 | 10 | 10 | 5 | 5 | — | — | 5 | — | — | 15 | — | — |
| Tuftec H1043 | — | — | 5 | 5 | 10 | — | — | 5 | — | — | 15 | 15 |
| KG1657 | — | — | — | — | — | 10 | — | — | 5 | — | — | — |
| HDPE | 30 | 40 | 30 | 40 | 30 | 30 | 30 | 30 | 30 | 30 | 30 | 20 |
| BPADP | 10 | 10 | 10 | 10 | 10 | 10 | 10 | 10 | 10 | 10 | 10 | 10 |
| Tensile Elongation | 37 | 54 | 37 | 58 | 4 | 24 | 12 | 8 | 11 | 79 | 14 | 9 |
| FM | 1433 | 1242 | 1725 | 1519 | 1986 | 911 | 1695 | 2020 | 1456 | 1225 | 1950 | 2153 |
| Abrasion resistance | 655 | 126 | 777 | 184 | >1000 | 241 | >1000 | >1000 | 696 | 487 | >1000 | >1000 |

*Comparative example

Similar to Examples 1–13, Examples 14–25 show that the desired combination of tensile elongation, flexural modulus and abrasion resistance is difficult to achieve. Surprisingly, compositions using high density polyethylene, when compared to comparable compositions comprising polypropylene, have lower tensile elongation, higher abrasion resistance, and somewhat higher flexural modulus.

While the invention has been described with reference to a several embodiments, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiments disclosed as the best mode contemplated for carrying out this invention, but that the invention will include all embodiments falling within the scope of the appended claims.

All cited patents, patent applications, and other references are incorporated herein by reference in their entirety.

The invention claimed is:

1. An electrical wire comprising:

a conductor; and a covering disposed over the conductor wherein the covering comprises a thermoplastic composition and the thermoplastic composition comprises:

(i) a poly(arylene ether);

(ii) a polyolefin;

(iii) a block copolymer; and (iv) a flame retardant wherein the electrical wire has an abrasion resistance of greater than 100 cycles, as determined by the scrape abrasion specification of ISO 6722 using a 7 Newton load, a needle having a 0.45 millimeter diameters, and an electrical wire having a conductor with a cross sectional area of 0.22 square millimeters and a covering with a thickncss of 0.2 millimeters, and wherein the thermoplastic composition has a tensile elongation at break greater than 30% as determined by ASTM D638-03 using a Type I specimen and a speed of 50 millimeters per minute, and a flexural modulus less than 1800 Megapascals (Mpa) as determined by ASTM D790-03 using a speed of 1.27 millimeters per minute, and wherein the poly(arylene ether) and the polyolefin are present in amounts such that the weight ratio of the poly(arylene ether) to polyolefin is 1.0 to 1.6.

2. The electrical wire of claim 1 wherein the thermoplastic composition is essentially free of an alkenyl aromatic resin.

3. The electrical wire of claim 1, wherein the thermoplastic composition comprises a continuous polyolefin phase and a dispersed poly(arylene ether) phase.

4. The electrical wire of claim 1, wherein the polyolefin comprises polypropylene, high density polyethylene or a combination of polypropylene and high density polyethylene.

5. The electrical wire of claim 4, wherein the polypropylene comprises a polypropylene homopolymer, a polypropylene copolymer or a combination of a polypropylene homopolymer and a polypropylene copolymer.

6. The electrical wire of claim 4, wherein the high density polyethylene comprises homo polyethylene, a polyethylene copolymer or a combination of homo polyethylene and a polyethylene copolymer.

7. The electrical wire of claim 4, wherein the polypropylene has a melt flow rate of 0.4 grams per 10 minutes to 15 grams per 10 minutes when determined according to ASTM D1238 using powdered or pelletized polypropylene, a load of 2.16 kilograms and a temperature of 230° C.

8. The electrical wire of claim 4, wherein the high density polyethylene has a melt flow rate of 0.29 grams per 10 minutes to 15 grams per 10 minutes when determined according to ASTM D1238 using either powdered or pelletized high density polyethylene, a load of 2.16 kilograms and a temperature of 190° C.

9. The electrical wire of claim 4, wherein the polypropylene has a melting temperature greater than or equal to 134° C.

10. The electrical wire of claim 4, wherein the high density polyethylene has a melting temperature greater than or equal to 124° C.

11. The electrical wire of claim 1, wherein the block copolymer comprises a diblock copolymer and a triblock copolymer.

12. The electrical wire of claim 11, wherein the triblock copolymer and diblock copolymer have a weight ratio of 1:3 to 3:1.

13. The electrical wire of claim 1, wherein the flame retardant comprises an organic phosphate ester.

14. The electrical wire of claim 13, wherein the organic phosphate ester comprises a bis-aryl phosphate having the Formula III:

(III)

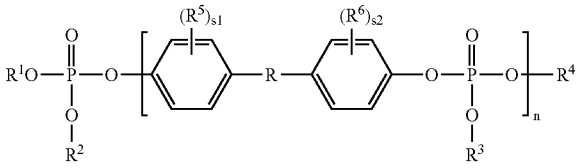

wherein R, $R^5$ and $R^6$ are independently an alkyl group having 1 to 5 carbons and $R^1$–$R^4$ are independently an alkyl, aryl, arylalkyl or alkylaryl group having 1 to 10 carbons; n is an integer equal to 1 to 25; and s1 and s2 are independently an integer equal to 0 to 2.

15. The electrical wire of claim 13, wherein the thermoplastic composition has a phosphorus content of 0.8 to 1.2 weight percent based on the combined weight of poly (arylene ether), polyolefin, block copolymer and organic phosphate ester.

16. The electrical wire of claim 1, wherein the poly (arylene ether) comprises a capped poly(arylene ether).

17. The electrical wire of claim 1, wherein the thermoplastic composition is substantially free of visible particulate impurities.

18. The electrical wire of claim 1, wherein the thermoplastic composition is substantially free of particulate impurities greater than 15 micrometers.

19. The electrical wire of claim 1, wherein the poly (arylene ether) has an initial intrinsic viscosity greater than or equal to 0.35 deciliter per gram as measured in chloroform at 25° C.

20. The electrical wire of claim 1 wherein the abrasion resistance is greater than or equal to 150 cycles.

21. The electrical wire of claim 1 wherein the tensile elongation is greater than or equal to 40%.

22. The electrical wire of claim 1, wherein the block copolymer comprises at least one block (A) and at least one block (B) and block (B) is a controlled distribution copolymer.

23. The electrical wire of claim 1, wherein the polyolefin is present in an amount by weight and the poly(arylene ether) is present in an amount by weight and the amount by weight of the polyolefin is less than the amount by weight of the poly(arylene ether).

24. The electrical wire of claim 1, wherein the block copolymer comprises a first block copolymer having an aryl alkylene content greater than or equal to 50 weight percent based on the total weight of the first block copolymer; and a second block copolymer having an aryl alkylene content having an aryl alkylene content less than 50 weight percent based on the total weight of the second copolymer.

25. The electrical wire of claim 1 further comprising an intervening layer disposed between the conductor and the covering.

26. The electrical wire of claim 25 wherein the intervening layer comprises a foamed composition.

27. An electrical wire comprising:

a conductor; and a covering disposed over the conductor wherein the covering comprises a thermoplastic composition and the thermoplastic composition comprises:

(i) a poly(arylene ether);

(ii) a polyolefin;

(iii) a block copolymer; and (iv) a flame retardant wherein the electrical wire has an abrasion resistance of greater than 100 cycles, as determined by the scrape abrasion specification of ISO 6722 using a 7 Newton load, a needle having a 0.45 millimeter diameters, and an electrical wire having a conductor with a cross sectional area of 0.22 square millimeters and a covering with a thickness of 0.2 millimeters, and wherein the thermoplastic composition has a tensile elongation at break greater than 30% as determined by ASTM D638-03 using a Type I specimen and a speed of 50 millimeters per minute, and a flexural modulus less than 1800 Megapascals (Mpa) as determined by ASTM D790-03 using a speed of 1.27 millimeters per minute, and wherein the block copolymer comprises a block that is a controlled distribution copolymer.

* * * * *

UNITED STATES PATENT AND TRADEMARK OFFICE

CERTIFICATE OF CORRECTION

PATENT NO. : 7,217,886 B2
APPLICATION NO. : 11/381607
DATED : May 15, 2007
INVENTOR(S) : Vijay R. Mhetar et al.

It is certified that error appears in the above-identified patent and that said Letters Patent is hereby corrected as shown below:

Column 2:
Line 39, after "millimeter" delete "diameters" and insert therefor --diameter--;

Column 3:
Line 4, after "inclusive", insert --of--;

Column 17:
Line 67, after "millimeter" delete "diameters" and insert therefor --diameter--;

Column 20:
Line 11, after "copolymer", delete "having an aryl akylene content";
Line 32, after "millimeter" delete "diameters" and insert therefor --diameter--.

Signed and Sealed this

Twenty-eighth Day of August, 2007

JON W. DUDAS
*Director of the United States Patent and Trademark Office*